US005649329A

United States Patent [19]

Horcher et al.

[11] Patent Number: 5,649,329

[45] Date of Patent: Jul. 22, 1997

[54] DEVICE FOR LIFTING AND/OR TRANSPORTING OF A PERSON, IN PARTICULAR A PATIENT LIFTER

[75] Inventors: Stefan Horcher; Willi Horcher, both of Schöneck, Germany

[73] Assignee: Horcher GmbH, Nidderau, Germany

[21] Appl. No.: 567,276

[22] Filed: Dec. 5, 1995

[30] Foreign Application Priority Data

Dec. 6, 1994 [DE] Germany ..... 9419518 U
Apr. 21, 1995 [DE] Germany ..... 19514170 U

[51] Int. Cl.[6] ..... A61G 7/10

[52] U.S. Cl. ..... 5/83.1; 5/87.1

[58] Field of Search ..... 5/83.1, 84.1, 85.1, 5/86.1, 87.1, 89.1

[56] References Cited

U.S. PATENT DOCUMENTS 2,272,778 2/1942 Reuter ..... 5/85.1
2,688,410 8/1954 Nelson .
3,694,829 10/1972 Bakker ..... 5/87.1
4,125,908 11/1978 Vail et al. ..... 5/83.1
4,712,257 12/1987 James ..... 5/83.1
5,499,408 3/1996 Nix ..... 5/85.1

FOREIGN PATENT DOCUMENTS 0034386 7/1984 European Pat. Off. .
3643612 6/1987 Germany .

*Primary Examiner*—Michael F. Trettel
*Attorney, Agent, or Firm*—Dennison, Meserole, Pollack & Scheiner

[57] ABSTRACT

A patient carrier unit for a person lifting and transporting device comprising a first and a second section mounted on opposite sides of a vertical shaft and capable to rotate with respect to a holding device. The first section including a belt for supporting the upper body portion of a person and the second section including a belt for supporting the legs of the person, the second section including an eletrical drive for changing the vertical position of the leg supporting belt.

15 Claims, 5 Drawing Sheets

146
148
150
35
+
39
12
33
37
−
18
20
12
22
24
25
31
52
23
29
27

DEVICE FOR LIFTING AND/OR TRANSPORTING OF A PERSON, IN PARTICULAR A PATIENT LIFTER

FIELD OF THE INVENTION

A device for lifting and/or transporting of a person, in particular a patient lifter, having a carrier unit swivelable about a vertical axis and in its turn having on opposite sides of this vertical axis first and second sections of the carrier unit for first and second fasteners for a carrier belt holding the person, said belt comprising a leg part and an upper body part, with one of the sections being rotatable about a horizontal axis.

BACKGROUND OF THE INVENTION

A corresponding floor lifter is described in the brochure of the company Meyra Rollstühte und Rehabilitationsmittel, August 1984. Here the carrier unit having the article number 249 0001 comprises tubes bent to a "U" shape, the free ends of which are connected by rigid rods that in their turn form first and second fasteners for a carrier belt. The tubes bent to a "U" shape are connected centrally to one another and by a journal that extends from an arm.

DE 36 43 612 describes an invalid lifting device having a belt suspension unit support extending from an arm and from which extends a fork-shaped belt suspension unit of rigid one-side type that is hinge-mounted on the belt suspension unit support and pivotable about a horizontal axis. The belt suspension unit support itself is attached pivotably about a vertical axis to the arm.

The fork shape of the belt suspension unit and its rigid one-side design result on the one hand in a restriction of the freedom of movement of a patient being lifted or transported, and on the other hand in a shift of the patient's weight to the horizontal axis of the belt suspension unit in particular to such an extent that handling is more difficult and swiveling of the belt suspension unit itself is rendered almost impossible because of the lever arms occurring.

EP 0 034 386 describes a device for carrying a person in a sitting position that on the one hand is rotatable about a vertical axis and on the other hand has holders capable to pivot about a horizontal axis for fixing a leg section of a carrier belt. Upper body-side fasteners of the carrier belt extend from carrier arms that are capable to pivot about an axis inclined in relation to both the horizontal and the vertical. Adjustment of the sections or holders is by hand, so that considerable physical effort is needed in particular to move a heavy person to the desired position. This is however frequently only achieved to an inadequate extent, requiring frequent adjustment that might be irritating to the person being lifted.

OBJECT OF THE INVENTION

The object of the present invention is to design a device of the type described at the outset such that with a simple design its handling is both simplified and improved to the extent that a high degree of comfort is attained for the person being transported/lifted and the turning action remains unimpaired by possible weight shifts of the patient.

SUMMARY OF THE INVENTION

The object is substantially attained in accordance with the invention in that the first section of the carrier unit is fixed in position in relation to the vertical axis and the other, second section is mounted to pivot about the horizontal axis by an electrical drive unit or that the first and second sections are mounted to pivot independently of one another about a common horizontal axis or about horizontal axes that are offset in relation to one another by means of an electrical drive unit, with the second section preferably being operable by the drive unit via at least one worm gear unit. Here the vertical axis preferably passes through the intersection of bracket elements of the first section that are symmetrical to a mirror level.

In contrast to the prior art, the first and/or second sections of the carrier unit are adjusted independently of one another, permitting a better adjustment to the person being lifted/transported and to that person's weight. Since motor-powered adjustment is possible for at least one section, operation is also possible by persons of limited physical strength, with a very precise alignment of the carrier unit to the place where the patient is to be lifted or let down being possible. It is provided here in teachings that are inventive per se that the carrier unit is rotatably mounted about the vertical axis in a receptacle extending from a belt, in particular a ceiling lifter. The carrier unit can of course also extend from a belt of a floor lifter, with the belt preferably extending from a curved bracket.

In particular, and in a particularly noteworthy embodiment of the invention, it is provided that the second section which can pivot about the horizontal axis is adjustable using two worm gear units operable by the electrical drive unit. Since the two worm gear units are connected in series, a very precise adjustment is possible without the need for an oversized electrical drive unit.

To supply the electrical drive unit, without having to accept limits to rotatability about the vertical axis, an embodiment of the invention provides for the power to be supplied from the outside via slip rings from which extend connections inside a shaft forming the vertical axis. The connections then run to the motor.

The shaft is rotatably attached at the end part of an arc-shaped arm. The arc shape of the arm results in a large clearance between the person being transported and the arm proper, so that the necessary head clearance is provided. Alternatively, the shaft can be mounted in a sleeve-like receptacle connected via a holder to the belt of a ceiling lifter.

Limit switches can be provided to limit the movement of the rotatable section.

To achieve a favorable distribution of the forces to be absorbed by the carrier unit, it is provided that the leg part of the carrier belt be attached to the fasteners extending from the swivelable second section.

In a further embodiment of the invention, the second section is a closed bracket preferably of rectangular form, of which one side is intersected by the vertical axis. From the opposite side extends a preferably rod-like or tubular carrier element swivelable about a horizontal axis and having in the area of its end away from the bracket the second fasteners.

The first carrier unit section, preferably of fixed position in relation to the vertical axis, comprises two bracket elements, with each bracket element being of "L" shape with a first side extending from the housing passed through by the vertical axis and with a second side parallel to the vertical axis and provided in the area of its free end with one of the first fasteners. Each bracket element can be of rigid design here, with the first and second sides of the bracket elements being in a common plane.

The first bracket element sides extending from the holder and preferably in a horizontal plane can diverge in the direction of their ends away from their holder and preferably form an obtuse angle.

Further objects and advantages of the invention will become apparent from the following description of the accompanying drawings and the claims.

DETAILED DESCRIPTION OF THE INVENTION

Figure 1:
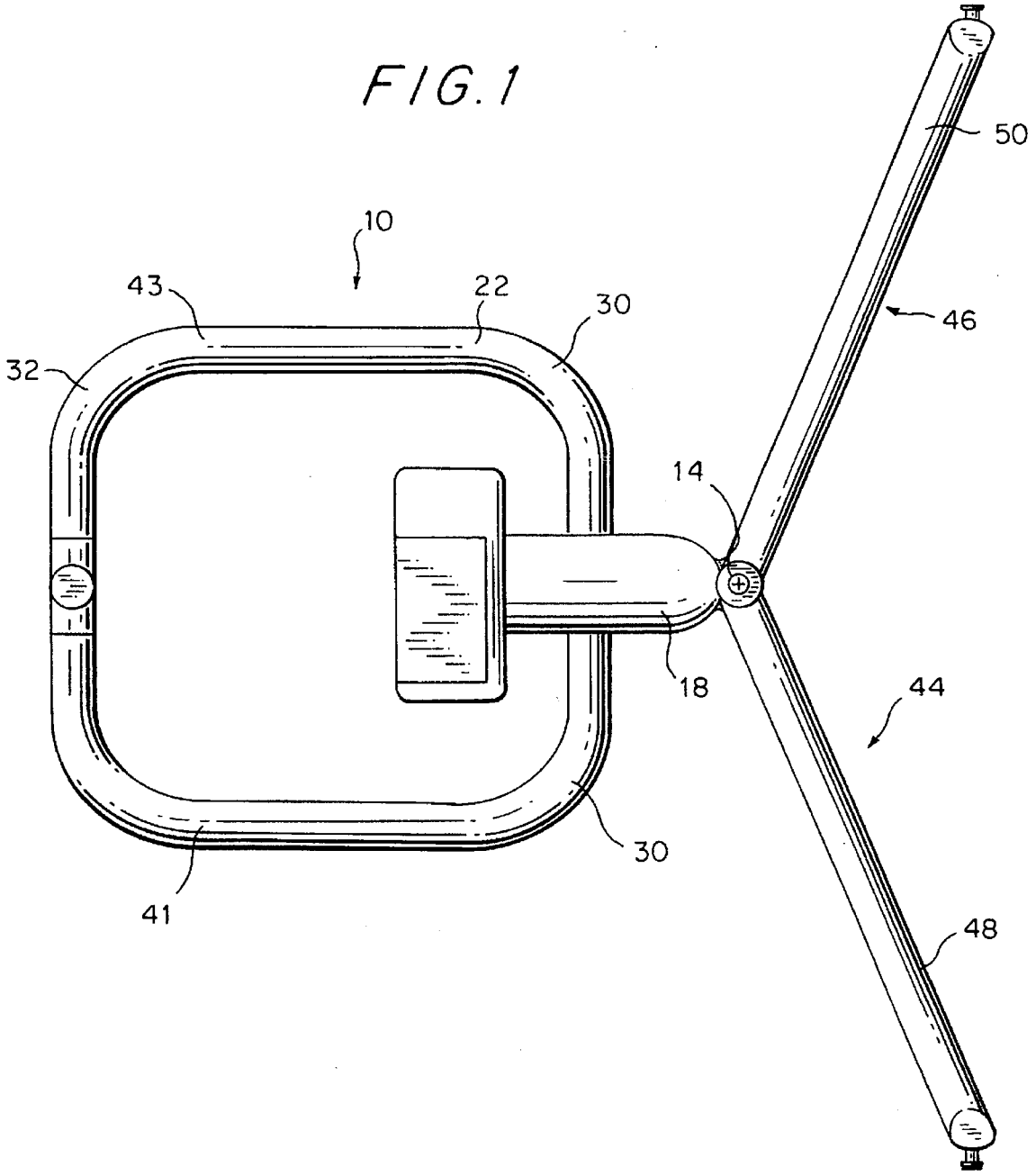
FIG. 1 shows a plan view of a carrier element of a device in the form of a floor lifter for lifting and/or transporting a person.
Figure 2:
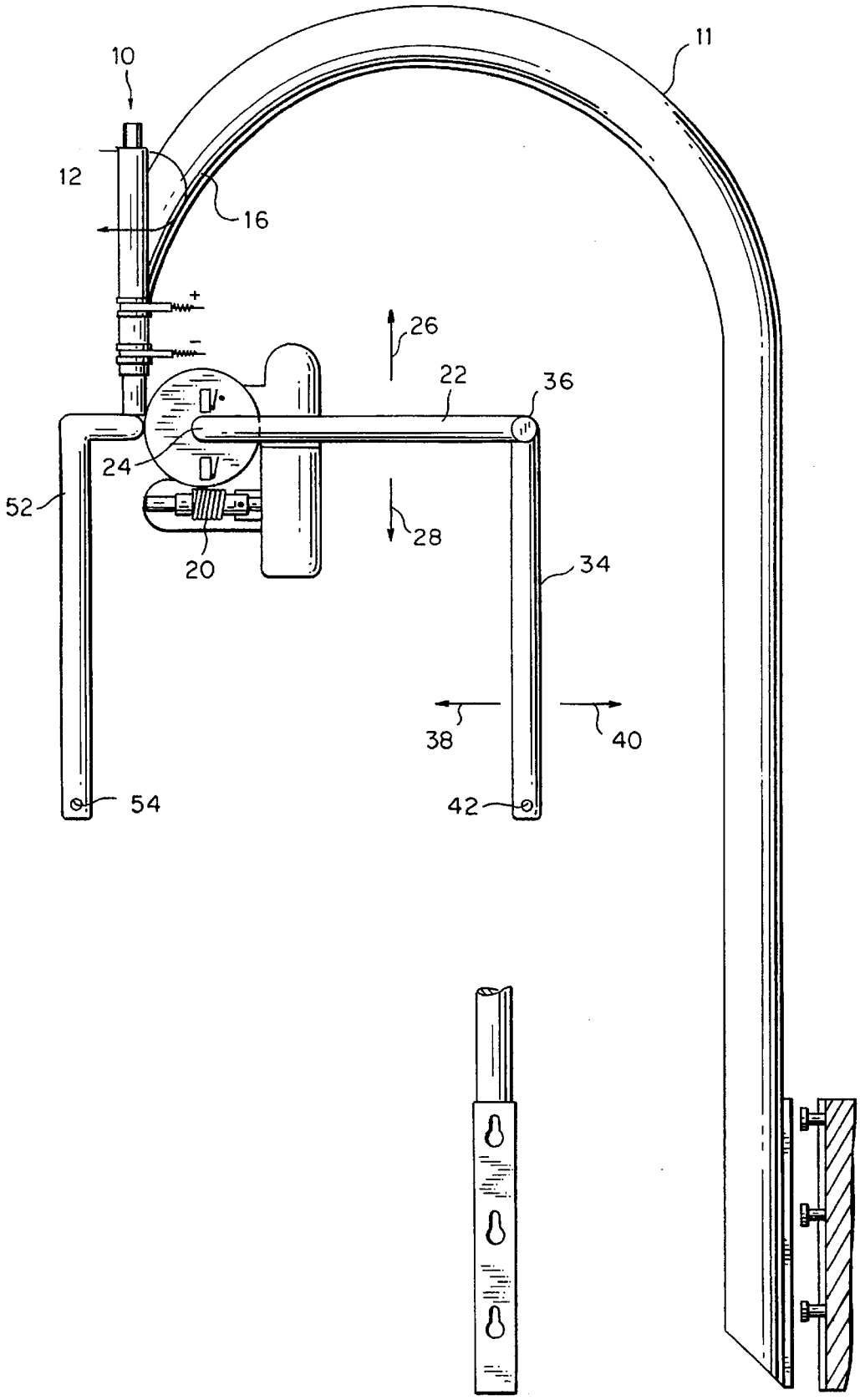
FIG. 2 shows a side view of the carrier unit in accordance with FIG. 1.
Figure 3:
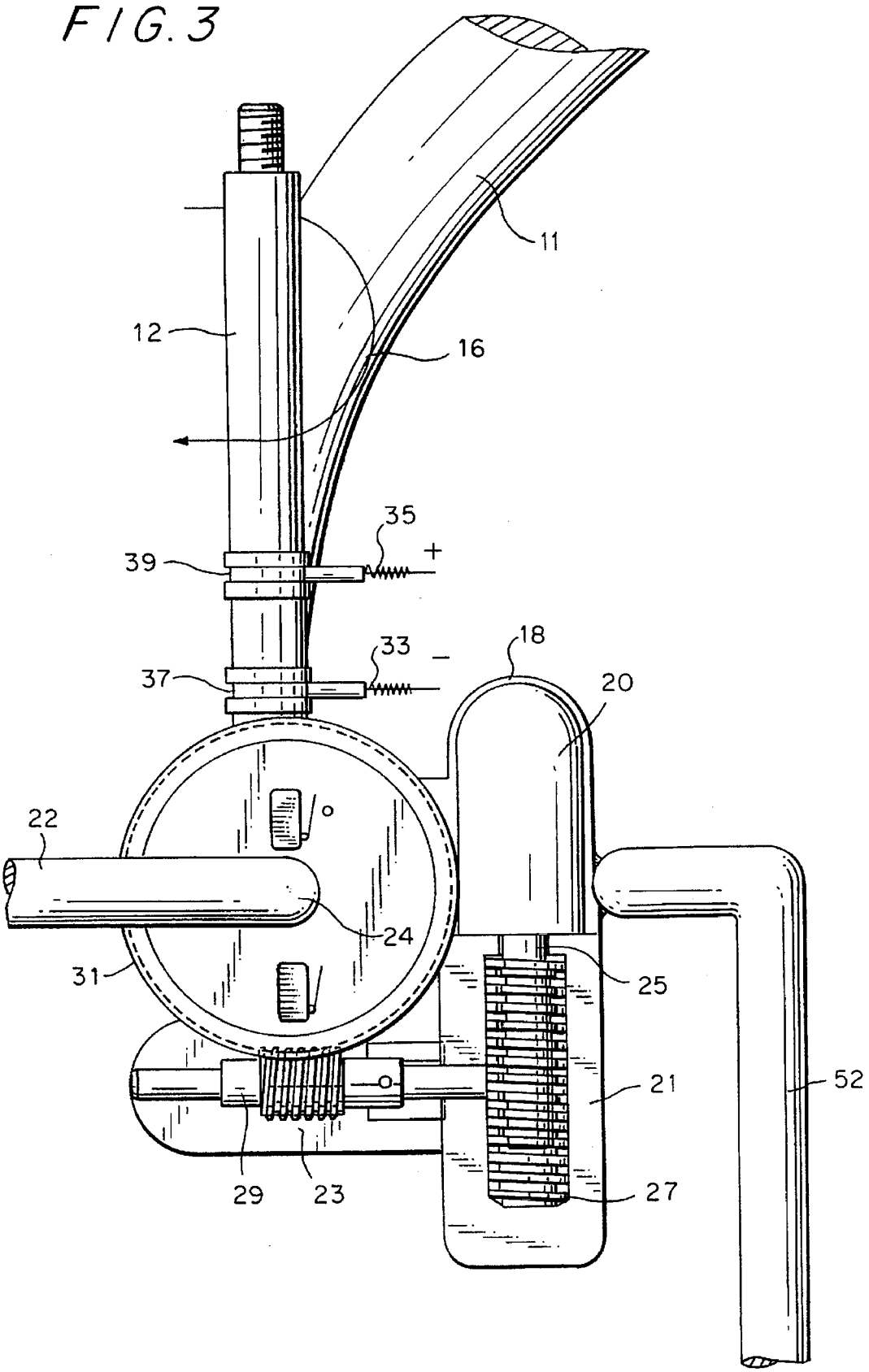
FIG. 3 shows a section from FIG. 2 in enlarged form in the area of the electrical drive unit.

FIGS. 1 to 3 show a carrier unit (10) extending from an arc-shaped arm (11) of a patient lifter. Here the carrier unit (10) is rotatable on a shaft or a journal (12) about a vertical axis (14). This is indicated by the arrow (16).

The carrier unit (10) can also be described as a swiveling/rotating bracket for moving a person from, for example, a lying to a sitting position and also permitting that person's transportation, either using a movable frame or by means of a ceiling lifter, for example.

From the shaft (12) extends a housing (18) accommodating on the one hand a battery-powered electrical drive unit (20) and on the other hand two series-connected worm gear units (21) and (23). The worm gear unit (21) here comprises a worm (25) extending from the drive shaft of the motor (20) and engaging with a worm gear (27), from which in turn extends a worm (29) engaging with a further worm gear (31). From the worm gear (31) extends a bracket (22) that is rotatable about the horizontal rotary axis (24) of the worm gear (31) in the manner described below.

To connect the electrical drive unit (20) to an external voltage source without impairing the rotation of the shaft (12), electrical connections (33), (35) are connected to the motor (20) via slip rings (37) and (39) provided in the shaft (12).

The bracket (22) is swivelable about the horizontal axis (24) by the motor (20) and the two series-connected worm gear units (21) and (23). This is indicated by the arrows (26) and (28). The position of the horizontal axis (24) is such that it runs adjacently to the vertical axis resulting from the shaft or journal (12). To that end, the motor (20) is arranged on the side of the horizontal axis (24) away from the vertical axis (14).

The bracket (22) is preferably of closed design and has a rectangular or square form with rounded corners. One side (30) of the bracket (22) extends here along the horizontal axis (24).

Sides (41) and (43) extend from the side (30) and merge into an outer side (32) parallel to the side (30) along the axis (24).

A rod-like or tubular carrier element (34) extends from the center of the outer side (32) opposite the side (30) and is pivotable (arrows (38) and (40)) about an axis (36) parallel to the horizontal axis (24).

If no constraining forces act on this carrier element (34), it is aligned parallel to the vertical axis due to gravity forces.

The carrier element (34) has at its end away from the rotary axis (36) fasteners (42) for a carrier belt, for the leg part of the latter.

If the bracket (22) is on one side of the vertical axis, the other side has a section of the carrier unit (10) comprising two rigid bracket elements (44) and (46) forming an "L" shape. Each bracket element comprises sides (48) and (50) horizontal and extending from the axis (14), from each of which sides projects a vertical side (52) in the direction of the floor. The end of each vertical arm (52) is provided with a fastener (54) for the holding belt. In this area, the upper body of the person is supported.

If the bracket elements (44) and (46), i.e. their sides (48), (50), (52) forming an "L" shape, are designed as a rigid unit, the vertical sides can alternatively be hinge-mounted to the horizontal sides (48) and (50) thus can pivot about a horizontal axis.

Finally, it is also possible to rotate the bracket elements (44) and (46) independently of the closed bracket (22) with a separate electrical drive unit about a horizontal axis.

As FIG. 2 shows the arc-shaped arm for the carrier unit can be connected to a floor-side frame. Alternately, the frame can be mounted in which to allow movement.

Figure 4:
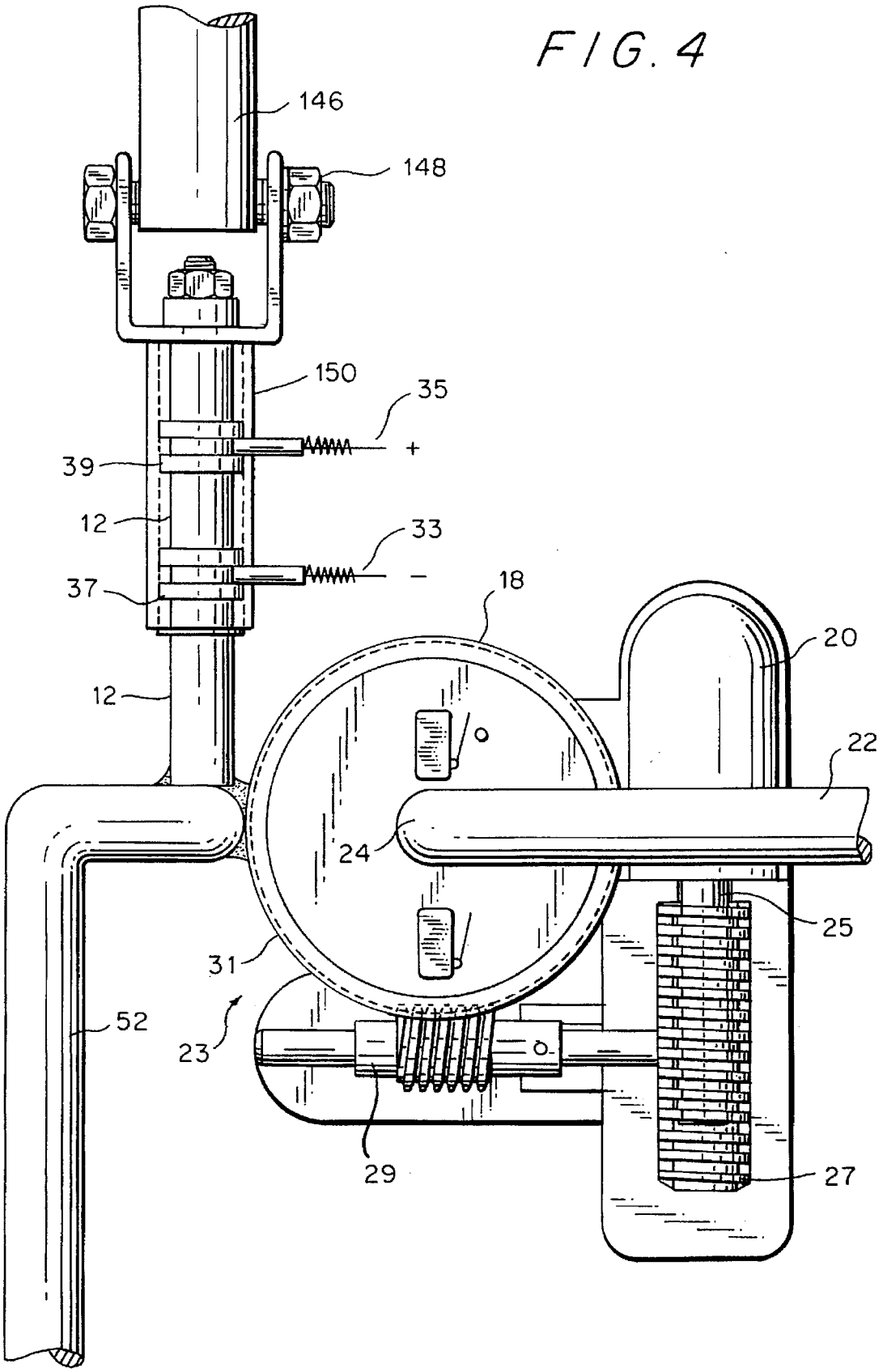
FIG. 4 shows a plan view of a carrier element of a device in the form of a ceiling lifter for lifting and/or transporting a person.

FIG. 4 shows in accordance with the invention, with identical references being used for elements corresponding to those in FIGS. 1 to 3.

In the embodiment in FIG. 4, the carrier unit is not rotatably mounted in an arm of a floor lifter, but extends—also rotatably mounted—from a belt (146) that is connected to a holder (148), from which extends in turn a sleeve-like receptacle (150) in which the shaft (12) of the carrier unit (10) is rotatably mounted. The belt (146) can here extend from a ceiling lifter. It is also possible to use this system for floor lifters having a belt extending from a frame.

Surprisingly, it has become clear that the carrier unit in accordance with the invention can be used with the same comfort in a lifter, in particular a ceiling lifter with a belt, with the simple electrical adjustment of the bracket (22) for keeping the person being transported level having proven itself particularly.

Figure 5:
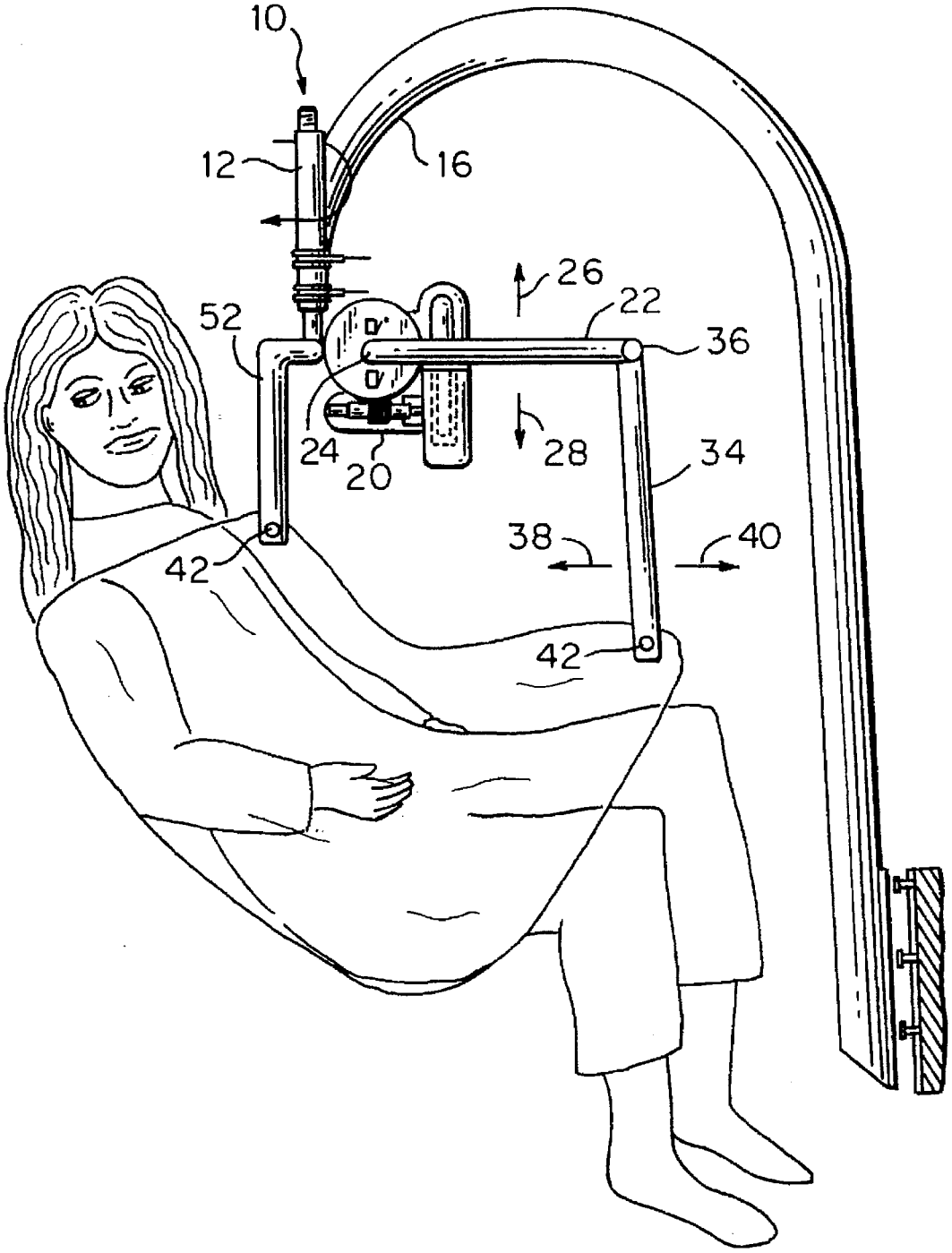
FIG. 5 shows a section of a floor lifter with a person.

The function of the carrier unit or of the pivotable bracket (22), rod (34) rotatable around horizontal axis (36) is further made clear in FIG. 5. In the manner described previously, a carrier belt is suspended from the fasteners (42) of the first and the second section of the carrier unit bracket (10) in order to pick up a person whose position can be changed simply by operating the electric motor (20) or by turning the carrier unit bracket (10) about its vertical axis.

In particular, FIG. 5 shows the teachings in accordance with the invention of equipping a patient lifter with a carrier unit (10) that has first section (22) and second section (52) mounted rotatable together about vertical axis (12) and section (22) independently pivotable about a first horizontal axis (24) in response to a motor driven gear. By this arrangement, the height position of a persons leg support belt can be varied with respect to the upper body support belt, while the entire carrier unit can be rotated as desired.

We claim:

1. A carrier unit for a person lifting and transporting device having a receptacle for a shaft extending along a vertical axis, said carrier unit comprising:

a shaft disposed along a vertical axis mounted for rotation in the receptacle, a first section fixed at a first position relative to the shaft, a second section at a second position relative to the shaft, the second position being opposite to the first position, said first and said second section rotatable together about the vertical axis, and a drive unit for rotating said second section about a horizontal axis.

2. The carrier unit according to claim 1 wherein said drive unit includes a housing fixed to the shaft having a vertical axis, an electric motor, a worm, a worm gear driven by the worm and a horizontal shaft rotatable by the worm gear, said horizontal shaft rotating said second section around the horizontal shaft.

3. The carrier unit according to claim 1, wherein said drive unit includes a housing fixed to the shaft having a horizontal axis, an electric motor, a first unit and a series connected second unit, each unit including a worm and a worm gear, the first unit worm being driven by the motor, the first unit gear driving the second unit worm and the second unit gear driving a horizontal shaft, the horizontal shaft rotating said second section around the horizontal shaft.

4. The carrier unit according to claim 1, wherein said first section includes a pair of bracket elements, each bracket element shaped as an "L" with a first leg extending horizontally and a second leg parallel to said vertical axis, fastening means disposed near a free end of each second leg for connection of a belt, the first legs of the bracket elements forming a rigid unit.

5. The carrier unit according to claim 4, wherein the first legs of the bracket element pair diverge in the direction of their ends at an obtuse angle.

6. The carrier unit according to claim 3, wherein said second section is formed as a closed bracket of substantially rectangular shape, a first portion of the bracket being connected to said horizontal shaft, a second portion of the bracket including a horizontal axis and a tubular element having a first end mounted on said horizontal axis, said tubular element capable to pivot about the horizontal axis.

7. The carrier unit according to claim 6, wherein said tubular element has a second end with fastening means for attachment of a belt.

8. A device for lifting and transporting a person comprising: a lifter including means for supporting a carrier unit capable to rotate about a vertical axis, said carrier unit including a shaft with an axis extending in a vertical direction, a first and a second section mounted on opposite sides of the shaft, first and second fasteners at ends of the first and the second section, belt means held by the fasteners, said belt means for holding a person, said belt means comprising a leg support belt and an upper body support belt, the first section being fixed relative to said vertical shaft the second section including means for pivoting about a horizontal axis, said means for pivoting including a housing, an electric motor, at least one worm gear unit and a shaft extending in a horizontal direction, so that operation of the electric motor rotates that second section about the horizontal axis, causing the relative position of the leg support and upper body support belt to change.

9. The device according to claim 8 including a battery connected to supply power to the electric motor.

10. The device according to claim 9 wherein the shaft of said carrier unit includes a pair of slip rings, electrical connections between slip rings and the electric motor so that an external voltage source can be employed to operate the electric motor.

11. The device according to claim 8 wherein said first section comprises a pair of substantially "L" shaped bracket elements, each element forming a horizontal side and a vertical side, a carrier belt for the upper body part of a person and fastening means for attaching carrier belt ends to a vertical side end of each bracket element.

12. The device according to claim 8 wherein said second section is formed as a closed bracket of substantially rectangular shape, a first portion of the bracket being connected to said horizontal shaft, a second portion of the bracket including a horizontal axis and a tubular element having a first end mounted on said horizontal axis, said tubular element capable to pivot about the horizontal axis.

13. The device according to claim 8, wherein the means for supporting the carrier unit is a receptacle extending from an arc-shaped arm of a lifter.

14. The device according to claim 8, wherein the means for supporting the carrier unit is a receptacle extending from the belt of a ceiling mounted lifter.

15. The device according to claim 8, wherein the means for supporting the carrier unit is a receptacle extending from a belt of a floor supported lifter.

* * * * *